US005105331A

United States Patent [19]

Dykstra et al.

[11] Patent Number: 5,105,331

[45] Date of Patent: Apr. 14, 1992

[54] IDLING SYSTEM FOR DEVICES HAVING SPEED CONTROLLERS

[75] Inventors: Richard A. Dykstra; John A. Fiorenza, II, Slinger, both of Wis.

[73] Assignee: Briggs & Stratton Corporation, Wauwatosa, Wis.

[21] Appl. No.: 466,781

[22] Filed: Jan. 18, 1990

[51] Int. Cl.[5] ..... H01H 47/00

[52] U.S. Cl. ..... 361/236; 123/339

[58] Field of Search ..... 361/236, 239, 240, 242; 123/339

[56] References Cited

U.S. PATENT DOCUMENTS

| | | | |
|---|---|---|---|
| 3,276,439 | 10/1966 | Reichenbach | 123/376 |
| 3,804,193 | 4/1974 | Ikuta | 307/346 |
| 3,952,829 | 4/1976 | Gray | 307/346 |
| 4,058,094 | 11/1977 | Moore | 123/356 |
| 4,252,096 | 2/1981 | Kennedy | 123/370 |
| 4,307,690 | 12/1981 | Rau et al. | 123/353 |
| 4,425,888 | 1/1984 | Eagel et al. | 123/339 |
| 4,471,735 | 9/1984 | Collonia | 123/339 |
| 4,531,489 | 7/1985 | Sturdy | 123/320 |
| 4,875,448 | 10/1989 | Dykstra | 123/352 |

OTHER PUBLICATIONS

*Motorola Catalog pages relating to MC14013B Dual Type D Flip Flop* pp. 6-33 through 6-36 of this catalog give design specifications and schematics for the MC14013B C1705 Flip Flop.

*Primary Examiner*—A. D. Pellinen
*Assistant Examiner*—Jeffrey A. Gaffin
*Attorney, Agent, or Firm*—Andrus, Sceales, Starke & Sawall

[57] ABSTRACT

An idling system is disclosed for devices such as internal combustion engines having a speed controlling or governor. When no load is sensed by a load sensing means, a disable means generates a disable signal to deactivate the engine's speed controller after a predetermined time delay period. When a load is sensed, the disable means is itself disabled, allowing the device's speed control means to operate the device at the higher governed speed.

26 Claims, 3 Drawing Sheets

IDLING SYSTEM FOR DEVICES HAVING SPEED CONTROLLERS

BACKGROUND OF THE INVENTION

This invention relates to idling systems for operating a device at a reduced speed when no load is applied to the device. More particularly, this invention relates to an idling system for use with a device that also has a speed control system.

Speed control systems that cause devices such as power producing, transferring and absorbing machines to operate at a fixed speed when a load is electrically connected to the machine are well known in the art. Such speed control systems are commonly referred to as "speed governors". Such speed governors typically are either of the mechanical type or of the electronic type.

Various types of mechanical governors are well known in the art. When a load is typically applied to a power producing device such as an internal combustion engine having a simple mechanical governor, the speed or RPM of the engine decreases significantly below the no load speed. To reduce speed droop upon loading, the sensitivity of mechanical governors may be increased. However, as the mechanical sensitivity of the governor is increased, the engine and control mechanism tend to become unstable.

Electronic speed governors are also well known in the art. Such electronic devices permit more accurate control of engine speed and minimize engine speed droop with load while at the same time decreasing engine instability.

Electronic speed controllers or governors are known which operate the device at a fixed speed or RPM when a load is applied, but cause the device to be operated at a different or lower speed as soon as the load is electrically disconnected from the device. The problem with such idlers is that continuous cycling may occur between the higher governed speed and the idle speed if the load is intermittently applied to the device for brief periods of time. For example, in the construction industry a generator device may be used to power a drill or other construction equipment. The drill or other equipment may be used intermittently by the worker; it may be operated for a few seconds or a few minutes, then stopped for a few seconds, and then operated again. Since the generator that powers the drill or load is constantly operating, it will cycle between the governed speed and the lower idle speed if the idler takes over as soon as the load is disconnected from the generator.

SUMMARY OF THE INVENTION

An idling system is disclosed for use with devices that power loads, where the device also has a speed control means such as a governor for adjusting the speed of the device, and where the device also has a load sensing means that senses whether a load is applied to the device.

The idling system includes a disable means for outputting a disable signal to the speed control means. The disable signal disables the speed control means after a predetermined time delay period when the load sensing means senses that no load is being applied to the device. The idling system also includes a time delay means for delaying the outputting of the disable signal to the speed control means for a predetermined time delay period so that the device may be started and to minimize cycling between the governed speed and the idle speed. An activation means may also be included for activating the speed control means by disabling the disable means when the load sensing means senses that a load is being applied to the device.

In a first embodiment, the time delay means includes an input means for receiving a periodic signal representative of at least one revolution of the device and a first capacitor that is charged by the periodic signal. The disable means includes a first switch that is activated when the first capacitor is charged and which outputs the disable signal.

Also in a first embodiment, the activation means includes a full wave rectifier that rectifies a load sensing signal generated by said load sensing means, a second capacitor that is charged by the rectified load sensing signal, and a second switch that is activated when the second capacitor is charged. The first capacitor thereafter discharges to deactivate the first switch, thereby preventing the disable means from outputting the disable signal to the speed control means. The first embodiment of the idling system may also include a conditioning means for conditioning the load sensing signal, and a resistor connected to the first capacitor that enables the first capacitor to fully discharge after the device stops operating.

In a second embodiment, the disable means includes an AND gate whose inputs are the inverted load sensing signal and the output from the time delay means. In the second embodiment, the time delay means includes first and second pluralities of frequency dividers which frequency divide down a clock signal and output a positive-going, frequency divided signal after a time delay period to the AND gate. When both the inverted load sensing signal is high-indicating that no load is applied-and the output signal from the time delay means is high, the AND gate outputs a disable signal to disable the engine's speed control means.

The second embodiment also includes a starting means for disabling the disable means during engine starting, thereby allowing the engine to reach a predetermined minimum RPM before the idling system is operable. The starting means includes a counter that counts engine revolutions and outputs a low speed signal when the speed of the device is below the predetermined minimum speed. The starting means also includes an OR gate that has the low speed signal and the load sensing signal as inputs.

It is a feature and advantage of the present invention to provide an idling system for use with devices such as internal combustion engines which have electronic governors.

It is another feature and advantage of the present invention to provide an idling system with a time delay to reduce cycling of the device speed between the higher governed speed and the lower idle speed.

It is yet another feature and advantage of the present invention to provide a low cost idling system which may be retrofit onto a device having an electronic governor.

It is yet another feature and advantage of the present invention to provide an idling system which automatically begins operation after engine start-up without manual intervention.

These and others features and advantages of the present invention will be apparent to those skilled in the art from the following detailed description and the drawings of the preferred embodiments, in which:

BRIEF DESCRIPTION OF THE DRAWING

FIG. 3A is the left hand side of the schematic, and FIG. 3B, is the right hand side.

DETAILED DESCRIPTION OF THE PREFERRED EMBODIMENT

The idling system according to the present invention is described herein in connection with internal combustion engines. However, the present description is for illustrative purposes only, and the 10 idling system of the present invention may also be used with various types of power producing, transferring and absorbing devices. For example, it may also be used to regulate or control the speed of electric motors, electric generators, clutches, brakes, and continuous variable transmissions.

The idling system according to the present invention is designed to be used with devices having a speed controller or electronic governor. One suitable governor is disclosed in U.S. Pat. No. 4,875,448 issued Oct. 24, 1989 to Richard A. Dykstra and assigned to Briggs & Stratton Corporation, the assignee of the present invention. The disclosure of U.S. Pat. No. 4,875,448 is specifically incorporated by reference herein.

Figure 1:
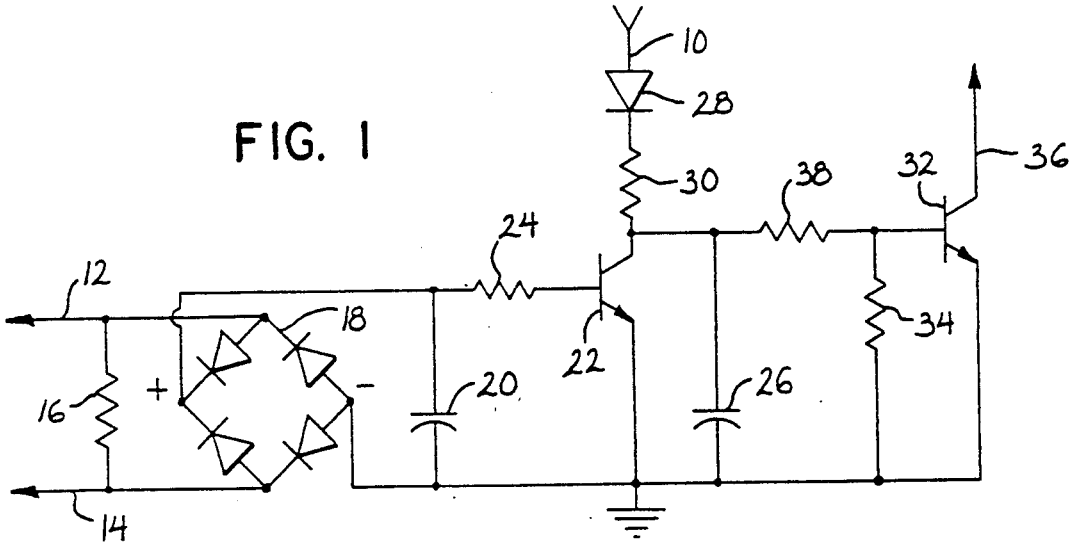
FIG. 1 is a schematic drawing of a first embodiment of the present invention.

Referring now to FIG. 1, a periodic square wave signal is input to the idling system by input means 10. The periodic signal is preferably related to the speed of the device, and may represent one or more revolutions of the device. The periodic signal may be derived from a timer in the device's electronic speed control circuit. If the idling system of the present invention is used with the governor disclosed in U.S. Pat. No. 4,875,448, the periodic signal input to input means 10 may correspond to the output from the timer of the '448 patent. Alternatively, the input periodic signal may be derived from an alternator winding if an alternator is used on the internal combustion engine, or from an alternator powered by an internal combustion engine. Other sources of the input periodic signal may be used.

In FIG. 1, leads 12 and 14 are connected to a load sensing toroid coil (not shown) which is wound around the generator's power lead wire if the idling system is used in a generator. The purpose of the load 10 sensing toroid is to sense whether a load is applied to the device. If a load is so applied, a load sensing voltage signal is developed across the load sensing toroid. Resistor 16 connected across the toroid acts as a filter to help limit electrical noise across the toroid. The diode bridge 18, along with second capacitor 20, develop a DC voltage to bias on second transistor switch 22 through resistor 24.

When no load is sensed by the load sensing means or when the engine is being started, periodic signals input by input means 10 pass through diode 28 and resistor 30 and charge first capacitor 26 since the second switch, transistor 22, is then off. When capacitor 26 becomes sufficiently charged, first switch 32 begins to conduct. The turning on of the disable means, transistor 32, causes a disable signal to be generated on line 36 connected to the power semiconductor device of the speed controller. If the speed controller is the one described in U.S. Pat. No. 4,875,448, the power semiconductor device corresponds to the power transistor which controls the engine throttle positioner solenoid as described in the '448 patent.

In the alternative, the disable signal could be used to reset the counters in an electronic governor, or it could turn on a solenoid to override a mechanical governor.

The fact that the idling system according to the present invention uses the power transistor and throttle positioner solenoid of the device's electronic governor enables the idling system to be sold without those components. This reduces the overall cost of the idling system, and allows the idling system to be retrofit onto devices having a suitable speed control circuit.

Also, the embodiment depicted in FIG. 1 is an automatic idling system in that it is engaged without manual operator intervention. That is, no manual switch is needed to activate the idling system after the engine is cranked as is required in other idling systems.

The disable signal generated by transistor 32 along line 36 is a low voltage signal which is lower than the voltage signal applied to the speed controller's power semiconductor device. Other types of disable signals could be used. The low voltage signal causes the control voltage signal of the speed controller's power semiconductor device to be reduced to the value of the collector-emitter voltage of transistor 32. As a result, the speed controller's throttle positioner is de-energized, and a throttle return spring (not shown) brings the device down to a low idle speed since the power semiconductor device's control voltage then becomes too low to sustain conduction through the power semiconductor device.

The time delay means, including input means 10 and first capacitor 26, delays the outputting of the disable signal. The time delay means preferably imposes a five to fifteen second delay between the time that the engine is first cranked or the load is disconnected from the device and the outputting of the disable signal which disables the device's speed controller. This time delay increases the chance that the engine will start by allowing the engine to operate at speeds higher than the idle speed during starting. When the engine is running, this time delay lessens the number of cyclings between the higher governed speed and the idle speed caused by the intermittent application and disconnection of the load to the device.

When a load is applied to the device, an activation means activates the speed controller by disabling the disable means. The activation means includes diode bridge 18, second capacitor 20, second transistor switch 22, and resistor 24.

When a load is applied, the load sensing voltage signal is rectified by full wave bridge rectifier 18 and charges second capacitor 20. When the voltage becomes sufficiently high the rectified and filtered load sensing signal is applied to the base of second transistor 22 through resistor 24, thereby activating or turning on transistor 22. When second transistor 22 is activated by being turned on, first capacitor 26, which had been charged through diode 28 and resistor 30 by the periodic signal, discharges immediately through the collector-emitter junction of transistor 22. The base-emitter junction of first transistor 32 then becomes too low to sustain conduction, and the first switch, transistor 32, is turned off.

The turning off of first transistor 32 disables the disable means consisting of first switch 32, causing the outputting of the disable signal to cease. When first transistor 32 is activated by being turned on, it outputs the disable signal to the device's speed control means.

The cessation of the disable signal allows the speed controller's power semiconductor device to be activated, causing the speed controller to operate the engine at its fixed, higher governed speed.

When the load is thereafter removed from the engine, first capacitor 26 must once again charge before first transistor 32 is able to conduct, so that a brief time delay of five to fifteen seconds occurs before the engine returns to its lower idle speed. Resistor 34 allows capacitor 26 to become completely discharged after operation of the device has stopped, thus completely resetting the idling system.

Figure 2:
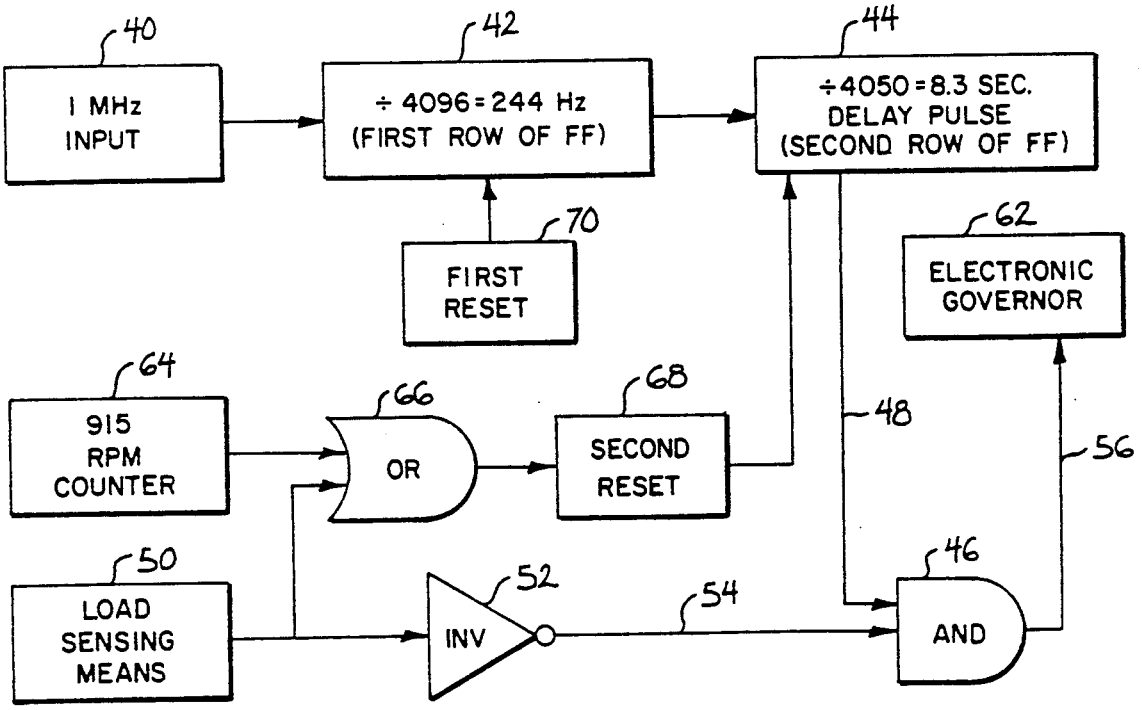
FIG. 2 is a flow diagram of a second embodiment of the present invention.

FIG. 2 is a flow diagram of a second embodiment of the present invention. As can be seen from FIGS. 2, 3A and 3B, the second embodiment employs digital circuitry whereas the first embodiment depicted in FIG. 1 uses analog components. However, the second embodiment uses a load sensing means similar to that discussed in connection with FIG. 1, as long as the load sensing means used with the second embodiment outputs a 5 volt DC load sensing signal when a load is present.

The operation of the second embodiment will be discussed in connection with FIG. 2. In FIG. 2, a 1 MHz input signal is input via input 40 to a first plurality of frequency dividers 42. Although it is assumed that a 1 MHz input clock signal is used, a wide range of alternate input frequencies could be used.

The clock signal may be input from the timer in the engine's speed controller, or from any other oscillator such as a readily available, inexpensive, accurate crystal oscillator.

Figure 3A:
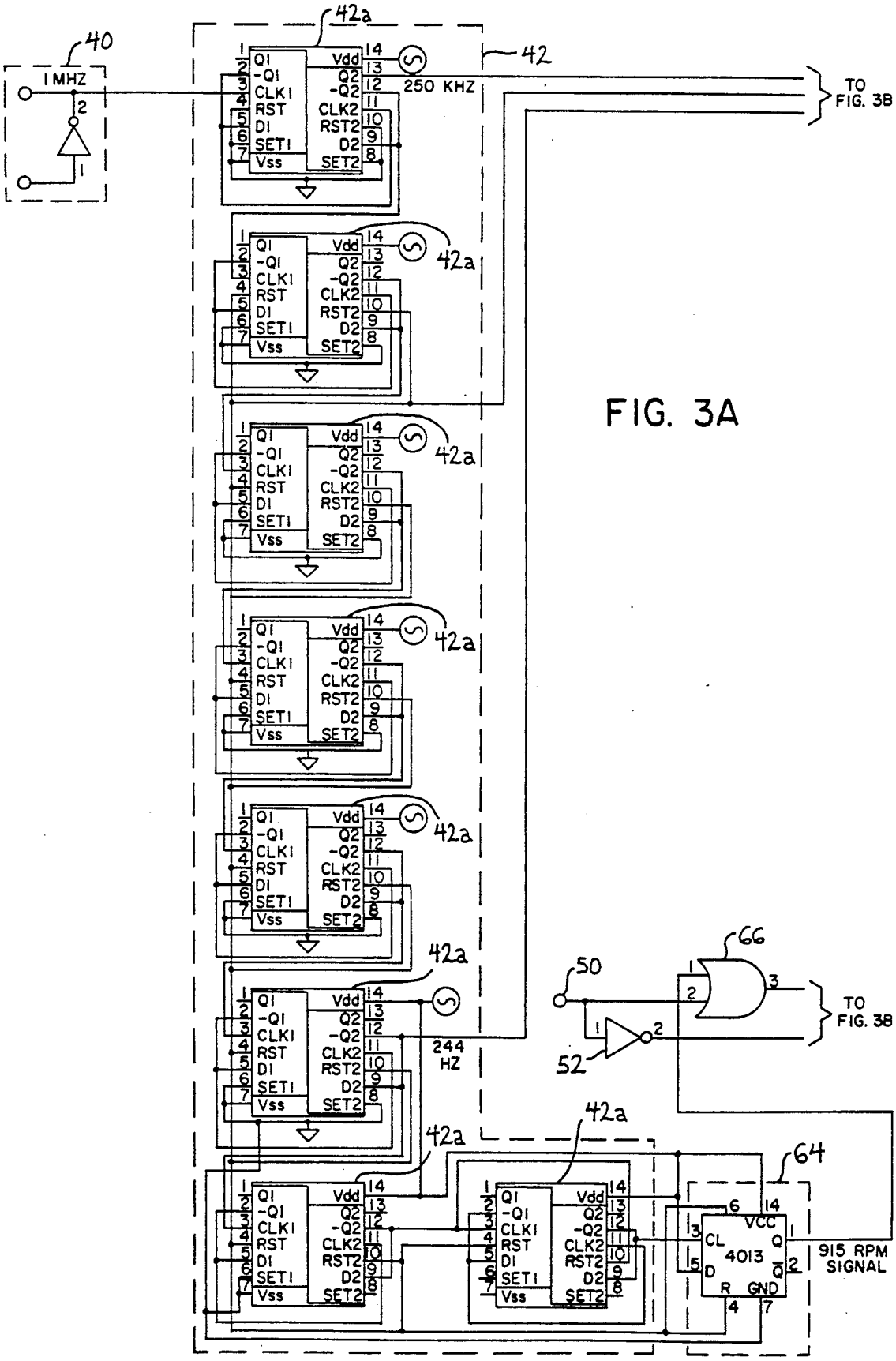
FIG. 3A and 3B together comprise a schematic diagram of the second embodiment of the present invention.

The first plurality of frequency dividers 42, which correspond to the row of flip flops on the left hand side of FIG. 3A, divide the 1 MHz input clock signal by 4,096 to yield a 244 Hz signal. The 244 Hz signal is output to a second plurality of frequency dividers 44, corresponding to the row of flip flops in FIG. 3B. Although the second embodiment of the present invention uses flip flops as divide-by-two frequency dividers, it is apparent that other types of frequency dividers could be used. Indeed, the frequency dividers could be eliminated altogether if the input clock signal had a low enough frequency so that the timing delay pulse signal of appropriate duration would be output without further frequency division.

In FIG. 2, the second plurality of frequency dividers 44 divides the 244 Hz output from frequency dividers 42 by 4,050 to yield an 8.3 second delay pulse. That is, the output from frequency dividers 44 will go to its low state for 8.3 seconds and thereafter to its high state. The output from frequency dividers 44 is input to AND gate 46 via line 48. The other input of AND gate 46 is obtained from the output of load sensing means 50, which output is inverted by inverter 52. The inverted load sensing signal is input to AND gate 46 via line 54. Another multiple input gate such as a NAND, OR or NOR gate could be used in place of AND gate 46 with suitable changes in the circuit.

AND gate 46 outputs a disable signal via line 56 to electronic governor 62 only when both of its inputs are positive-going pulses. The inputs to AND gate 46 are both positive only when no load is sensed by load sensing means 50 and when the timing delay signal has ended. In other words, when no load is sensed by load sensing means 50, the electronic governor 62 will not be disabled until an 8.3 second time delay period has passed. The delay period minimizes cycling between the lower idle speed and the higher governed speed when a load is intermittently applied to the device. No such cycling will occur until 8.3 seconds have passed.

The delay period of 8.3 seconds was chosen for illustrative purposes; other delay periods could be used and still be within the scope of the present invention. However, the desired range of time delay periods is typically between about five and fifteen seconds. The length of the time delay period could be changed by choosing a different frequency clock signal and/or a different number or combination of frequency dividers 42 and 44.

The second embodiment also includes a starting means consisting of a counter 64 and an OR gate 66. The function of the starting means is to disable the load sensing means 50 while the engine speed is less than a predetermined number of revolutions per minute. In the second embodiment, counter 64 determines whether the time between successive ignition pulses is greater than 65 milliseconds. A time period of 65 milliseconds between successive ignition pulses corresponds to an engine speed of 915 RPM. In effect, the starting means disables the load sensing means and the disable means when the engine speed is less than about 915 RPM, thereby allowing the engine to reach this predetermined speed before the idling system is operable. Other predetermined minimum engine speeds could be chosen by varying the desired time, as determined by counter 64, between successive ignition pulses.

When the engine is being started, no load is present. Thus, the idling system would normally be operable to disable the electronic governor 62 and return the engine speed to idle speed after an 8.3 second delay. However, the starting means is used in place of the time delay period during engine starting. When the time period between successive ignition pulses is greater than 65 milliseconds, counter 64 outputs a positive-going pulse to the input of OR gate 66 as depicted in FIG. 2. Holding this input of OR gate 66 high effectively disables the load sensing means 50 and the disable means as discussed below.

The positive-going pulse input to OR gate 66 causes second reset 68 to reset the second plurality of frequency dividers 44. The resetting of frequency dividers 44 causes the output transmitted along line 48 to the input of AND gate 46 to go low, causing the output of AND gate 46 along line 56 to governor 62 to be zero. Thus, governor 62 is operable so that the engine runs at the higher governed speed until the engine reaches the predetermined minimum RPM, and the idling system is then inoperable.

After the minimum engine RPM is reached, counter 64 outputs a negative-going signal to the input of OR gate 66, so that the output of OR gate 66 and the resetting of frequency dividers 44 via second reset 68 depends exclusively on whether a load is sensed by load sensing means 50. If a load is sensed by load sensing means 50, the output of OR gate 66 goes positive, causing reset 68 to reset frequency dividers 44. The resetting of dividers 44 causes the dividers to output a negative-going pulse to AND gate 46. AND gate 46 then cannot output a disable signal, thus allowing the governor 62 to control the engine speed when a load is present.

When no load is present and when the engine speed exceeds the minimum engine RPM, load sensing means 50 and counter 64 both output negative-going pulses to OR gate 66, so that the output of OR gate 66 is negative-going. The second reset 68 does not reset frequency dividers 44. Thus, counters which comprise frequency dividers 44 will count down, causing the output of the time delay means to go positive after the time delay period. The AND gate 46 then outputs a disable signal via line 56 to electronic governor 62 since the AND gate also receives the positive, inverted load sensing signal as an input. The electronic governor will then be disabled, and the engine will return to its lower idling speed.

The first plurality of frequency dividers 42 is reset by a first reset 70. Reset 70 outputs a positive-going 4 millisecond pulse every other engine revolution to reset frequency dividers 42.

As with the first embodiment depicted in FIG. 1, the disable signal output by AND gate 46 could be used to ground the base of the governor's power transistor, to reset the counters in the electronic governor, or to turn on a solenoid to override a mechanical governor.

Figure 3B:
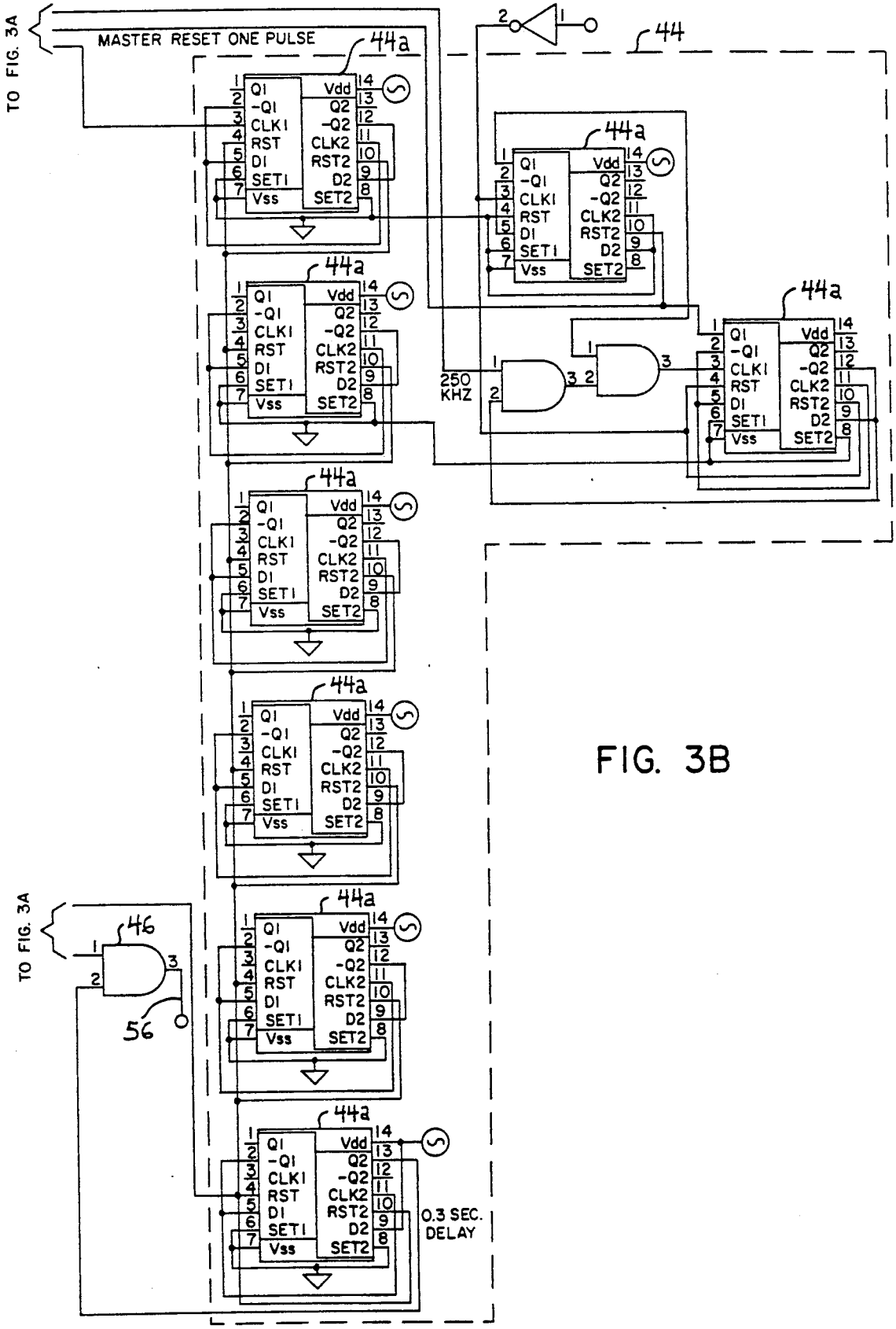

FIGS. 3A and 3B together comprise a schematic diagram of the second embodiment of the present invention. The schematic depicted in FIGS. 3A and 3B correspond to the flow chart depicted in FIG. 2 discussed above. In FIG. 3A, the first plurality of frequency dividers 42 is comprised of flip flops 42*a*. Each of flip flops 42*a* is a model 4013 dual type D CMOS flip flop such as that manufactured by Motorola under Part No. MC14013B. Each of the devices 42*a* actually consists of two flip flops or divide-by-two frequency dividers.

Similarly, the second plurality of frequency dividers 44 depicted in FIG. 3B consists of a plurality of flip flop frequency dividers 44*a*, each of which is a model 4013 device like dividers 42*a*.

Counter 64 (FIG. 3A) used to generate the 915 RPM reference signal is also a model 4013 flip flop except that counter 64 is connected such that only one of the flip flops is utilized.

Although the idling system of the present invention may be used with a wide variety of devices, it is particularly suitable for generators powered by internal combustion engines having a rating of up to 24 horsepower. It may be used with larger generators as well. It is particularly suitable for use with small generators used in the construction industry to power tools such as drills and the like.

Although preferred embodiments of the present invention have been shown and described, other alternate embodiments will be apparent to those skilled in the art and are within the intended scope of the present invention. Thus, the present invention is to be limited only by the following claims.

We claim:

1. An idling system for use with a device that powers a load, said device having a speed control means for adjusting the speed of the device and also having a load sensing means for sensing whether a load is applied to said device and for outputting a load sensing signal when a load is so applied, said idling system comprising:

disable means for outputting a disable signal to said speed control means to disable said speed 10 control means after a time delay period when said load sensing means senses that no load is being applied to said device, and for activating said speed control means by ceasing the outputting of said disable signal when said load sensing means senses that a load is being applied to said device; and time delay means for delaying the outputting of said disable signal to said speed control means for said time delay period.

2. The idling system of claim 1, wherein said time delay means includes:

clock means for outputting a periodic clock signal to said disable means.

3. The idling system of claim 1, wherein said time delay means includes:

input means for receiving a periodic clock signal; and at least one frequency divider means for frequency dividing said periodic clock signal and outputting a divided frequency signal after said time delay period to said disable means.

4. The idling system of claim 3, wherein said frequency divider means includes a flip-flop.

5. The idling system of claim 3, wherein said disable means includes a multiple input gate that receives as its inputs a signal functionally related to said load sensing signal and also receives said divided frequency signal, and which outputs said disable signal.

6. The idling system of claim 5, further comprising:

starting means for disabling the disable means until the device reaches a predetermined minimum speed, said starting means including:

means for outputting a low speed signal when the speed of the device is below the predetermined minimum speed; and an OR gate having the low speed signal as an input and whose output resets said frequency divider to prevent said frequency divider from outputting a divided frequency signal.

7. The idling system of claim 1, wherein said disable means includes a multiple input gate.

8. The idling system of claim 1, further comprising:

starting means for disabling the disable means until the device reaches a predetermined minimum speed.

9. The idling system of claim 8, wherein said starting means includes:

means for outputting a low speed signal when the speed of the device is below the predetermined minimum speed; and an OR gate having the low speed signal as an input and whose output disables said disable means.

10. The idling system of claim 21, further comprising:

a resistor that enables said capacitor to fully discharge after said device stops operating.

11. The idling system of claim 1, wherein said time delay means includes:

input means for receiving a periodic signal from said device; and a capacitor that is charged by said periodic signal.

12. The idling system of claim 11, wherein said periodic signal is related to the speed of said device.

13. The idling system of claim 12, wherein said periodic signal represents at least one revolution of said device.

14. The idling system of claim 12, wherein said periodic signal is a square wave in which each pulse represents a single revolution of said device.

15. The idling system of claim 1, wherein said disable means includes a switch that is activated in response to said time delay means to output said disable signal.

16. The idling system of claim 1, wherein said disable means includes:

a full-wave rectifier that rectifies said load sensing signal;

a capacitor that is charged by said rectified load sensing signal; and a switch which is activated when said capacitor is charged to prevent said disable means from outputting said disable signal to the speed control means.

17. An idling system for use with a device that powers a load, said device having a speed control means for adjusting the speed of the device and also having a load sensing means for sensing whether a load is applied to the device and for outputting a load sensing signal when a load is so applied, said idling system comprising:

disable means for outputting a disable signal to said speed control means to disable said speed control means after a time delay period when said load sensing means senses that no load is being applied to said device, and for ceasing the outputting of said disable signal to activate said speed control means when said load sensing means senses that a load is being applied to said device, said disable means including a multiple-input gate that receives as its inputs a signal functionally related to said load sensing signal and also receives a divided frequency signal after a time delay period, and which outputs said disable signal; and time delay means for outputting said divided frequency signal after said time delay period to said multiple-input gate.

18. The idling system of claim 17, wherein said time delay means includes:

input means for receiving a periodic clock signal; and at least one frequency divider means for frequency dividing said periodic clock signal and outputs a divided frequency signal after said time delay period to said gate.

19. The idling system of claim 17, further comprising:

starting means for disabling the disable means until the device reaches a predetermined minimum speed.

20. An idling system for use with a device that powers a load, said device having a speed control means for adjusting the speed of the device and also having a load sensing means for sensing whether a load is applied to said device and for outputting a load sensing signal when a load is so applied, said idling system comprising:

disable means for outputting a disable signal to said speed control means to disable said speed control means after a time delay period when said load sensing means senses that no load is being applied to said device;

time delay means for delaying the outputting of said disable signal to said speed control means for a time delay period; and activation means for activating said speed control means when said load sensing means senses that a load is being applied to said device.

21. The idling system of claim 20, wherein said time delay means includes:

input means for receiving a periodic signal from said device; and a capacitor that is charged by said periodic signal.

22. The idling system of claim 21, wherein said periodic signal is related to the speed of said device.

23. The idling system of claim 22, wherein said periodic signal represents at least one revolution of said device.

24. The idling system of claim 22, wherein said periodic signal is a square wave in which each pulse represents a single revolution of said device.

25. The idling system of claim 20, wherein said activation means includes:

a full-wave rectifier that rectifies said load sensing signal;

a capacitor that is charged by said rectified load sensing signal; and a switch which is activated when said capacitor is charged to prevent said disable means from outputting said disable signal to the speed control means.

26. The idling system of claim 25, further comprising:

conditioning means for conditioning said load sensing signal.

* * * * *

UNITED STATES PATENT AND TRADEMARK OFFICE

CERTIFICATE OF CORRECTION

PATENT NO. : 5,105,331

DATED : April 14, 1992

INVENTOR(S) : Richard A. Dykstra et al

It is certified that error appears in the above-identified patent and that said Letters Patent is hereby corrected as shown below:

On title page, under item [56] "References", add ---4,532,901 8/1985 Sturdy .....123/333---; Col.7, line 62, after "speed" delete "10".

Signed and Sealed this

Third Day of August, 1993

Michael K. Kirk

MICHAEL K. KIRK

*Acting Commissioner of Patents and Trademarks*

*Attest:*

*Attesting Officer*